US006268685B1

(12) United States Patent
Stark et al.

(10) Patent No.: US 6,268,685 B1
(45) Date of Patent: Jul. 31, 2001

(54) HIGH EFFICIENCY LIGHT SOURCE UTILIZING CO-GENERATING SOURCES

(75) Inventors: Daniel Lee Stark, 1358 Pierce Ranch Rd., San Jose, CA (US) 95120; Alan Ten-Lien Chen, Palo Alto, CA (US)

(73) Assignee: Daniel Lee Stark, San Jose, CA (US)

( * ) Notice: Subject to any disclaimer, the term of this patent is extended or adjusted under 35 U.S.C. 154(b) by 0 days.

(21) Appl. No.: 08/919,641

(22) Filed: Aug. 28, 1997

(51) Int. Cl.[7] ..... H01K 1/32

(52) U.S. Cl. ..... 313/112; 313/578; 313/580; 313/635

(58) Field of Search ..... 313/483, 112, 313/578, 580, 635

(56) References Cited

U.S. PATENT DOCUMENTS

| | | |
|---|---|---|
| 2,859,369 | 11/1958 | Williams et al. . |
| 4,016,446 | 4/1977 | Cadoff . |
| 4,017,758 | 4/1977 | Almer . |
| 4,160,929 | 7/1979 | Thorington . |
| 4,229,066 | 10/1980 | Ramcourt . |
| 4,346,324 | 8/1982 | Yoldas . |
| 4,366,407 | 12/1982 | Walsh . |
| 4,532,073 | 7/1985 | Cormu . |
| 4,535,269 | 8/1985 | Tschetter . |
| 4,539,505 | 9/1985 | Riesberg . |
| 4,588,923 | 5/1986 | Hoegler . |
| 4,652,789 | 3/1987 | Kawakatsu . |
| 4,663,557 | 5/1987 | Martin . |

*Primary Examiner*—Ashok Patel

(57) ABSTRACT

A general service incandescent lamp including a housing with electrically conductive base (s); a transparent envelope; a radiation discriminative reflective film reflecting wasted radiation for recycling; a electrically driven filament; wherein an improvement is a new use of lightweight low thermal capacity insulator of fibrous ceramic material spatially formed to shade the lamp base from filament and/or reflected energy from a reflective film; wherein an improvement is to use the ceramic to shape the output beam to the solid angle of radiation; wherein an improvement contains a low thermal capacity insulator with candoluminescence material that when thermally exited emits radiation via candoluminescence improving the lamp's efficacy and color; wherein an improvement contains a larger optical spot size focusing requirement for the reflective mirror as compared to the spot size formed by the lamp's filament cross section, wherein an improvement is use of a polarized discriminative reflective film.

2 Claims, 6 Drawing Sheets

HIGH EFFICIENCY LIGHT SOURCE UTILIZING CO-GENERATING SOURCES

BACKGROUND OF THE INVENTION

A. Field of Invention

This invention introduces techniques to improve the efficacy and color rendering of electric lamps. Our invention utilizes the advantageous properties of: (1) candoluminescent materials, (2) high temperature low thermal capacity insulating materials, (3) discriminative reflective filters, and (4) integration of items 1 through 3 into a cooperative, co-generating arrangement using non-precise energy concentrating shapes for the form of the discriminative reflective filter. A secondary aspect of this patent is an improved efficacy for linear polarized light.

B. Description of Related Art

Some prior art provides a candoluminescent coating for an incandescent filament. Other prior art replaces the metal tungsten incandescent filament with resistive carbon doped candoluminescent material filament that heats to luminescence when an electrical current is applied. The candoluminescent filaments are lower temperature visible light generating sources that generate light via luminescence rather then black body radiation as utilized in the prior art tungsten incandescent filament designs.

Some prior art in the tungsten incandescent filament designs improves efficacy by increasing the temperature of the tungsten incandescent filament. The tungsten filament shifts its output spectrum toward the visible as the temperature is increased in accordance with the physics of blackbody radiation rules. Increasing the tungsten filament temperature is achieved by making the filament thinner. Typical operating temperature of a 75–100 watt tungsten incandescent filament is approximately 2550° C.

Other efficacy improvements utilizing discriminative reflective filters are described in the prior art, and applied in cases where the geometry fits the stringent focusing requirements. These designs provide a reflective discriminative filter, which allows the desirable wavelengths to transmit through the filter. The reflected wasted energy is precisely focused onto the tungsten incandescent filament, which allows energy recycling and light regeneration. Nearly ninety percent of the energy is wasted to IR radiation in the conventional incandescent tungsten filament design; therefore, energy recycling using the discriminative filters offer potentially a great energy saving.

The reflective discriminative filter prior art describes improvements to the design in several areas. These include: (1) filter's transmission efficiency for the desirable wavelengths, (2) filter's reflection efficiency for the undesirable wavelengths, (3) filter temperature survivability and, (4) identification of optically accurate shapes for the reflective filter substrate such as ellipsoidal, spherical, cylindrical or lens shaped in order to accurately focus the reflected energy onto the small area provided by the incandescent filament. Pertinent prior art designs are identified and discussed in the next section.

1. Prior Art and Disadvantages

The Prior art discussion below is grouped into the categories of: candoluminescent electric lamp designs, candoluminescent material selection, low thermal capacity structures and reflective discriminative filter designs.

a) Prior Art for Candoluminescent Electric Lamps

Two patents suggest use of candoluminescent materials as a replacement for the metal tungsten filament.

Use of candoluminescent material as an incandescent light source is suggested as a porous coating material on an incandescent filament. U.S. Pat. No. 4,539,505, by Riseberg; Leslie A. and entitled "Candoluminescent Electric Lamp Source," describes an electric lamp with a filament coated with candoluminescent material. The filament has a resistive core, which is heated electrically. Infrared radiation emitted by the resistive core is converted to visible light by a sheath of candoluminescent material surrounding the resistive core. The filament may be a sintered composition of carbon, ceric oxide and thorium dioxide.

U.S. Pat. No. 4,016,446 by Cadoff; Laurence H. entitled "Refractory-oxide-Based Incandescible Radiators and Method of Making" describes a design to make photoluminescent semi-conductive element that replaces the tungsten incandescent filament in electric lamps. The filament includes a thin oxide coating, selected to improve the visible radiation emission by luminescence.

There are several design disadvantages of U.S. Pat. No. 4,539,505 and U.S. Pat. No. 4,539,505. (1) The coated incandescent filament design does not improve on usage of reflective filters to regenerate the wasted energy because the target filament remains a small target requiring accurate focusing of the reflected radiation. (2) If the temperature of the filament is too hot, thermal quenching occurs which causes the luminescent material to shift its output luminescence into infrared wavelength versus the desirable visible light. The filament then becomes a blackbody light generation unit, losing all advantages of the potential lower temperature luminescence phenomena. (3) The output spectrum of a luminescent coil is restricted to the wavelengths available from the luminescent material, and does not include the wavelength spectrum of a tungsten incandescent filament using blackbody radiation.

b) Prior Art Identifying Candoluminescent Materials

Several prior arts identify materials other than thorium and calcium oxide for use in gas lanterns. The disadvantage of these prior arts is restricting applicability to gas lanterns.

U.S. Pat. No. 4,532,073 by Cornu; Aime, et. al. entitled "Candoluminescent Material and its Preparation" identifies an alternative for the radioactive thorium oxide. The candoluminescent materials are a mixture formed into a netting of zirconium oxide, calcium oxide, aluminum oxide and/or magnesium oxide. It is prepared by impregnating a combustible textile with a solution of zirconium and calcium salts, optionally containing aluminum, iron, manganese, praseodymium and/or cerium salts and then subjecting the impregnated textile to a combustion process in order to eliminate the textile and transform the salts into oxides.

U.S. Pat. No. 5,124,286 by Edgar; John P. entitled "Incandescent Mantles" provides a mantle composed of zirconia, yttria, erbia and ceria. The mantle for incandescent gas lamps can be made of a substrate impregnated with a solution of oxides of zirconium, erbium, yttrium and cerium. This mantle produces light outputs and color comparable to that of thorium mantles.

c) Prior Art Identifying Low Thermal Capacity Structures

No prior art was identified that describes utilization of existing low thermal capacity insulators as a method to improve efficacy for electric lamps.

d) Prior Art Identifying Discriminative Filter Designs

Selected prior art designs that use discriminative reflective filters to transmit the desirable wavelengths, and reflect the undesirable wavelengths back to the incandescent filament in order to heat the filament and cause energy recycling are identified below.

U.S. Pat. No. 2,859,369 Williams et al. provides a method to selectively reflect back to the incandescent filament the infrared energy. This is accomplished by providing an infrared filter that selectively reflects the wasted infrared light back to the filament, and allows the visible light to transmit through the filter. A small filament is at the geometrical center of a spherical surface which is coated with the reflecting film. The reflecting film precisely reflects the infrared light back to the small incandescent filament, thus recycling the energy into visible light. The inside of the film is coated with a Raleigh scatterer which acts to selectively scatter the desirable visible component of the radiated light out of the lamp.

Follow-on prior art to U.S. Pat. No. 2,859,369 improved aspects of the original patent. Selected pertinent examples of the reflective filter design are identified and discussed below.

U.S. Pat. No. 4,366,407 Walsh, Peter titled "Incandescent Lamp with Selective Color Filter" uses a transparent heat mirror coating on the lamp envelope. The heat mirror transmits desirable radiation in the visible range to produce a desired color and reflects the undesirable radiation back to the filament for energy recycling. U.S. Pat. No. 4,366,407 expands the design to include specific wavelengths in order to output a selected color.

U.S. Pat. No. 4,535,269 Tschetter; Charles D., et. al. titled "Incandescent Lamp" discloses a lamp having an incandescent filament, an improved inner shaped bulb and an infrared reflective film on the outer surface of the inner bulb. The inner bulb has an ellipsoidal shape which in conjunction with the infrared film, focuses the reflected IR back onto the incandescent filament. However, the ellipsoidal shape is an alternate shape still requiring precision optical focusing.

U.S. Pat. No. 4,663,557 Martin, Jr.; Robert L., et. al. titled "Optical Coatings for High Temperature Applications" discloses a coating that can withstand temperature environments in excess of 500° C. A tubular halogen lamp's efficiency is improved by twenty-five percent with the reflecting IR filter design; however, as the filament warps, this efficiency decreases because the filament warps away from the focal point.

The prior art cited above have the following collective disadvantages.

(a) Incandescent Filaments are the Only Recycling Body

All of the patents restrict the energy recycling by focusing the wasted energy back to the originating small tungsten incandescent filament. No secondary light generation sources are considered such as passive candoluminescent mantles. Discriminative reflective filters utilized with incandescent candoluminescent elements are not considered.

(b) Filament Coils Do not Fully Capture Reflected Energy

Successful precise aiming of wasted radiation energy onto the tungsten filament does not fully capture the energy because the coiled tungsten incandescent filament is not a solid body, but a coiled spring that has gaps between the coils. Part of the reflected light that is successfully aimed at the incandescent filament passes through the open parts of the coiled filament without striking the incandescent filament body wire.

(c) Small Filament Target Requires Precision Optical Focusing

A prior art disadvantage is the requirement that the reflecting substrate supporting the discriminative filter conform to an optically precise form sufficiently accurate to focus the wasted energy back to the small incandescent filament. The prior art requires the filament to be at the focal point of a optically accurate substrate. Because of the strict focusing accuracy, the prior art's focusing geometry is limited to spherical, tubular, ellipsoidal or lens shaped envelopes with the tungsten filament at the precise focus. The required precision makes the filter uneconomical and impractical.

The prior art designs further require sufficient structural temperature stability to avoid temperature induced warping which causes the focused energy to miss the filament because of structural and filament warping. The tungsten filament represents such a small target, that relatively high optical filter substrate shape stability and accuracy is required to successfully direct the wasted energy back to the filament. If the focal point misses the filament, the energy is lost to lamp heating, and in may cases lamp base heating. In most cases, filament heating and warping moves the filament out of the focal point. A typical coiled filament in a PAR (parabolic aluminized reflector) lamp increases length by approximately 20% when heated, causing significant filament sag.

The design for the tubular halogen lamp in U.S. Pat. No. 4,588,923 by Hoegler; Leonard E., et. al. provides a simple geometry where the existing exterior lamp envelope acts as a reflecting shape focusing the wasted light back to the tube's center onto the filament. A design disadvantage is that it does not accommodate filament warping. The filament does not remain at the tube's center because of heat induced warping. Thus any heat induced sagging or warping moves the filament from the tube's center apex, causing reflected energy to miss the incandescent filament, and causing a lamp temperature increase. The filament continues to warp with usage causing energy recycling efficiency degradation. Another disadvantage is the filter's temperature survivability requirement that requires the filter material to be at some distance from the incandescent filament to avoid overheating. As the filament warps, parts of the filament approach the discriminative filter, causing local hot spots that damage the discriminative filter. If the filter is mounted on the exterior, any contamination from handling or dust settling on the lamp also causes local heating which damages the filter, and adds to further heating and filter damage.

(d) Design Tradeoff Between Self Supporting and Efficiency

The tungsten incandescent lamp requires the incandescent filament to be both a self supporting structure and the source of desirable light. Efficiency is gained by heating the incandescent filament to higher temperatures usually achieved with smaller diameter incandescent filaments, but the self supporting requirement requires thicker wire for survivability. There is therefore a tradeoff between efficiency and the self supporting requirements which determine life-span and shock resistance. Any supporting structure acts to cool the incandescent filament, requiring more energy input to compensate for supporting structure's thermal drain.

(e) Restricted to Incandescent Lamps

The prior art restricts their applicability to incandescent lamps, and does not include fluorescent lamps. No patents include use of the discriminative polarized reflective filters to improve efficiency for fluorescent lamps.

(f) Full Spherical Light Generation

Common incandescent filament designs emit light in a full spherical radiation pattern which includes emitting light energy in undesirable directions such as toward the lamp base. The full spherical emission is mitigated partially by use of a reflector which takes the form of a mirror plating inside a cone shaped lamp envelope, or as an external reflector. The reflectors form a forward projected beam shape, but undesirably act to reflect some energy toward the lamp base. Other methods to minimize the light projected at the lamp base require mounting the cylindrical filament so that one end of the cylindrical element points at the lamp base which reduces the filament's radiant area directed toward the lamp base.

(g) Focusing Causes Filament Weak Spot

The spherical precision focusing configurations that concentrate the discriminative filter reflected energy onto one place on the filament causes excessive heating at that point, which forms a weak spot and causes filament failure.

(h) Polarized Reflective Filters not Mentioned

The prior art does not mention any method of improving efficacy for generation of linear polarized light by reflecting and recycling the wasted radiation by use of commercially available reflective polarizing filters. The patents restrict their applicability to wavelength bands.

SUMMARY OF THE INVENTION

The present invention improves efficacy by using a novel arrangement of materials and shaping as well as positioning. The invention generates visible light via both incandescence and luminescence, utilizing co-generation designs for desirable light production. The present invention improves electric light source efficacy by reflecting previously wasted energy in the unwanted wavelength bands for recycling via co-generation by both the incandescent filament, item 12, and the candoluminescent mantle, item 22. The filament-mantle arrangement, together with the low thermal capacity ceramic insulator, item 21, described herein allows more practical application of the prior art's IR reflective filter on lamp's inner and outer envelope surfaces. This application was not previously practical because of the prior art's stringent focusing accuracy requirements.

The present invention uses a candoluminescent mantle, item 22, comprised of oxides of zirconia, yttria, erbia and ceria. The mantle, item 22, is placed in a cavity formed as a semi-cylindrical concave depression, item 23. The cavity is formed in a special low thermal capacity, low thermally conductive ceramic material, item 21. The mantle, item 22, is heated by radiant energy directly from the incandescent filament, item 12, which is suspended near the center of the cavity's cylindrical axis. The mantle, item 22, is also heated by reflected radiant energy off the filter assembly, item 30. The reflector can be mounted on the inside of the exterior lamp envelope, item 10, or on a specifically designed interior structure, item 31. The shape of the reflectors, items 31 and 10, is not as critical as prior art requirements because the reflected energy can be non-uniformly directed at the mantle, item 22, and/or the incandescent filament, item 12. The mantle heating from either direct filament heating or reflected radiant energy by item 30 is sufficient to cause the candoluminescent mantle to luminescence similar to the process utilized by a gas lamp. By carefully selecting the luminescent mantle materials, the combined co-generating light can be designed to produce improved desired color rendering characteristics as compared to a pure incandescent filament source.

The insulator structure, item 21, that supports the candoluminescent mantle is a high temperature, low thermal capacity ceramic, similar to the space shuttle tiles. It is comprised of yttrium stabilized zirconium or high purity, fibrous ceramic such as alumina silica. These ceramics exhibit a very low thermal storage, are highly thermally insulating, light weight, and maintain their shape even at high temperature. This ceramic insulator, item 21, has a cavity, item 23, made into a shape of butter dish as shown in FIGS. 3 and 4 with a semi-cylindrical cavity whose inner surface supports the mantle, item 22. The inner cavity surface has its fibrous alumina silica fibers coated with luminescent materials. The ceramic insulator, item 21, provides physical support for item 22 as well as thermal insulation, causing IR radiant energy to be directed toward the cavity's cylindrical axis and the incandescent filament, item 12. The ceramic insulator, item 21 further adds benefit by shadowing the lamp base from both direct filament illumination, and reflected filter illumination. The high temperature thermal ceramic, item 21, is selected with a very low thermal capacity. Existing materials used for space shuttle tiles have such a low thermal capacity that these materials, when heated to red hot, can be handled with bare hands without injury to the hands.

In FIG. 8, the partially transmitting filter/reflector coating, item 32, on the bulb's inner envelope, item 10, provides energy saving via reflecting unwanted wavelengths and/or unpolarized light back to the filament-mantle for regeneration, while transmitting the desirable radiation. The mantle, item 22, is heated by radiant energy from two sources: (a) the incandescent filament, item 12, which is in close proximity and (b) the reflected spectral wavelengths from the filter/reflector, item 32. The discriminative filter, item 32, selectively discriminates against unwanted wavelengths and polarization but permits the desirable wavelengths and polarization to transmit through the filter.

In many cases, the existing lamp's outer envelope, item 10, is shaped with sufficient accuracy to reflect the wasted radiant energy back to the candoluminescent filament structure when a discriminative filter, item 32, is applied to the outer envelope, item 10. The goal is to concentrate the maximum reflected unwanted wavelengths and/or polarization back to item 20 with sufficient energy density as to cause the mantle, item 22, to luminescence. Focusing is not required because of the greater mantle size. The relaxed focusing requirement is one of the key beneficial factors of the present invention.

The shape of the conic bulb body can be the same as a conventional General Electric (GE) or Philips PAR bulb body, which provides sufficient focusing accuracy as shown in FIG. 8. The tubular shape in FIG. 10 also suffices with sufficient accuracy.

A. Object of the Invention

Our patent has several main objects which can be utilized separately to improve efficacy; however, when integrated, additional advantages are available. The objects are summarized below.

(1) Use of Candoluminescent Materials to:

(a) act as secondary desirable light generator, using the wasted energy generated by the incandescent filament, to generate light via luminescence, (b) act as a larger target to receive and recycle the discriminative filter reflected energy for light regeneration, thus providing for a relaxed form for the reflective filter substrate, (c) act as a source of additional wavelengths to augment the black-body incandescent filament color spectrum the.

(2) Provides a Low Thermal Mass Insulator Structure That:

(a) structurally supports the mantle and or incandescent filament, (b) acts as a thermal protector to shade the lamp base from the incandescent generated energy, (c) forms a partial energy trap to minimize thermal conduction and radiant energy in a selected solid angle, (d) acts in conjunction with the mantle to form a directed beam without the requirement for reflecting mirrored envelope.

(3) Provides for a Mirrored Linear Polarized Filter That:

(a) transmits desirable polarized light and (b) reflects unwanted polarization components back for energy recycling.

The specific advantages of the present invention as compared to the prior art are discussed below.

(a) Incandescent Filament Not the Only Recycling Body

A further object of this patent is to provide other structures that act to regenerate the wasted energy when heated by the wasted energy. These secondary structures are passive candoluminescent material structures referred to herein as a mantle. When the mantle is heated directly by radiation from the lamp's incandescent filament and/or wasted energy reflected by the discriminative filter, the mantle luminescence generates desirable light. The mantle acts as a secondary lower temperature light co-generating source in addition to the incandescent filament.

The utilization of candoluminescent medium to augment incandescent tungsten electric lamp spectral energy distribution and, therefore, the increasing efficacy of incandescent sources provides major energy savings. Recycling the wasted energy by use of discriminative filters further improves the efficacy.

(b) Filament-Mantle Poses Large Target Area for Reflected Energy

The incandescent filament-mantle structure acts as structure without gaps, and provides a larger cross sectional area as compared to the tungsten filament. Reflected energy that passed through the coiled incandescent filament gap will be captured by the mantle. The mantle recycles the energy and provides a secondary light co-generation source.

(c) Precision Focusing for Reflective Filters Relaxed

Our design does not require accurate focusing of the reflected energy. The combination mantle-filament provides a larger area than the prior art's incandescent filament, allowing for less geometrical optical precision to aim the wasted energy back for recycling. The precise shape and optical geometrical requirements for the reflecting filter's substrate are greatly reduced. The semi-spherical surface shape of the typical pear shaped lamp (i.e. A-bulb) provides sufficient accuracy to reflect the wasted wavelengths back to the incandescent filament-mantle. The discriminative filter's substrate can in most cases be the lamp's outer envelope, which is sufficiently far away from the incandescent filament to allow the discriminative filter to survive the temperature environment.

The decreased focusing accuracy requirements allow more degrees-of-freedom for substrate form design. The precise cylindrical, spherical and ellipsoidal shapes with the filament in the focal point are no longer the only practical designs. The form can now be non precisely ellipsoidal. The less stringent focusing requirements allows tolerance to thermal warping as compared to the prior art.

(d) No Design Tradeoff Between Self Supporting and Efficiency

The method of supporting the filament allows a rough service design that potentially can still utilize the thinner, hotter filament temperatures. If the supporting structure includes candoluminescent material mantle, the energy drained from the filament by thermal conduction is converted into useful wavelengths by the mantle.

(e) Fluorescent Lamps Efficacy Improvements

A polarization discriminative filter applied outside the fluorescent material in a fluorescent light, increases the efficiency by reflecting the incorrectly polarized light back into the fluorescent coating for recycling. Typically the fluorescent coating is excited by ultraviolet radiation emitted by the mercury gas. Redirecting the wasted radiation components back to the fluorescent coating acts to regenerate the desirable visible light, and recycle the wasted energy.

(f) Shaped Beam Light Generation Element

The preferred embodiments shown in FIGS. 12 and 13 emit radiation in a shaped beam profile dependent on cavity geometry relative to placement of the incandescent filament in the cavity. The substrate acts to thermally isolate the radiation that normally is projected into the unwanted directions including the lamp base. The high thermal resistance of the substrate acts to trap the thermal energy and prevent both conduction and radiation toward the unwanted directions such as the lamp base or lamp's sides. The cavity shape acts to shape the emitting beam pattern by trapping the light and thermal energy in all directions except in the desired beam shape profile. The reflective filter acts to further trap the wasted energy emitted from the cavity by reflecting the wasted energy back to the cavity for recycling. Thus the mantle-filament-insulator structure exhibits a beam shaping quality without the use of mirrored reflectors or beam shaping lens.

(g) Reflected Energy Evenly Distributed

Our design allows the reflected energy to either be evenly distributed over the filament to avoid causing a hot spot and filament failure, or to completely avoid the filament and direct the energy solely at the mantle.

Incorporation of a design that allows for a incandescent filament separated from a candoluminescent mantle, allows both light generating mechanisms to be operated at optimum temperatures. The incandescent filament can be operated at approximately 2550° C., while the candoluminescent material, requiring a lower temperature to avoid thermal quenching, can be operated at its optimum temperature.

Another advantage of an independent incandescent filament and luminescent mantle structure is chromaticity selection. The incandescent filament and the mantle need to be operated at different temperatures. The emitted wavelength composition of the incandescent radiator is dependent on black-body temperature characteristics and is usually rich in reds, while the emitted wavelength composition of the mantle is a function of mantle material and temperature and can be selected to be rich in blues. The design degrees-of-freedom allow a more wavelength rich light composition than available with either single element incandescent filament or mantle.

(h) Efficacy Gained using Reflective Polarized Filters

An object of this invention is to provide a mirrored polarizing filter that is used to reflect the unpolarized wasted components of the incandescent radiation back to the filament-mantle or fluorescent coating as in the case of fluorescent lights. The advantage is improved efficacy for a incandescent linear polarized light source because the potentially wasted 97% energy is reflected back for recycling.

A. LIST OF REFERENCE NUMERALS IN FIGURES

Figure 1:
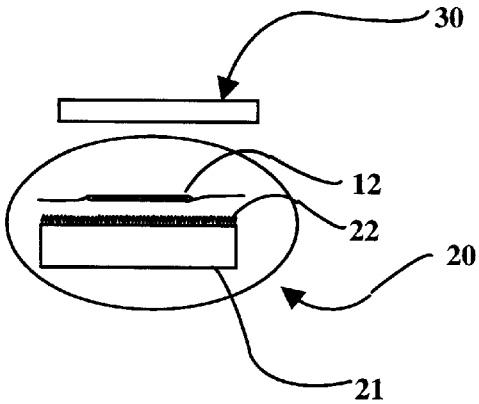
FIG. 1 is a side view of the filament-mantle assembly 20 and the filter assembly 30.

Item 10 is the outer lamp's envelope.
Item 11 is the lamp's base socket.
Item 12 is the incandescent lamp's filament.
Item 13 is the electrical lead-in wire carrying current from the lamp socket to the incandescent filament or arc lamp tube.
Item 14 is the lamp's lens which projects the emitted radiant light.
Item 15 is the lamp's inner reflective coating used to shape the projected beam.
Item 16 is the alumina arc tube containing high pressure sodium.
Item 20 is the filament-mantle assembly consisting of the incandescent filament, item 12, the luminescent material coating referred to as a mantle, item 22, and the low thermal capacity ceramic insulator, item 21.
Item 21 is the low thermal capacity ceramic insulator.
Item 22 is the mantle on the item 21.
Item 23 is the cavity formed in item 21, and coated with item 22.
Item 24 is the support structure for item 20, e.g. the button rod of A-bulb.
Item 25 is the support structure for a arc tube and mantle insulator structure.
Item 30 is the filter assembly consisting of the reflective substrate, Item 31, and the discriminative filter, item 32.
Item 31 is the reflective substrate.
Item 32 is the discriminative filter.

DETAILED DESCRIPTION OF THE INVENTION

A. Description of the Drawings

Figure 2:
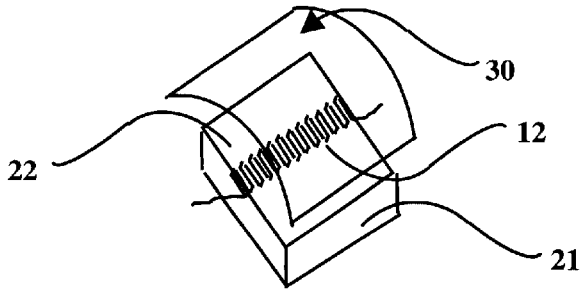
FIG. 2 is an isometric view of FIG. 1.

FIGS. 1 and 2 show a simplified embodiment which demonstrates placement of the present invention's objects. FIG. 1 is a side view showing the filament-mantle assembly, item 20, and a discriminative filter substrate assembly, item 30. The filament-mantle assembly, item 20, consists of the incandescent filament, item 12, and the candoluminescent mantle, item 22, which is backed by a low thermal capacity insulator, item 21 . The discriminative filter substrate assembly, item 30 is shown placed above item 12. The arrangement is shown isometrically in FIG. 2. Item 12 is shown as a flattened coiled incandescent filament winding. The distance between items 12 and 22 is selected based on item 12's wattage, and item 22's temperature required to luminescent. Item 21 is shown as a simple block of low thermal capacity insulator material. The filter assembly, item 30, is shown with a curved shape that nominally reflects the wasted energy back to the filament, item 12, and/or the mantle, item 22. The drawing detail does not show supporting structure or connecting electrical wires to item 12. These drawings depict the concept of our invention, and a simple placement to integrate the objects of the invention.

Figure 3:
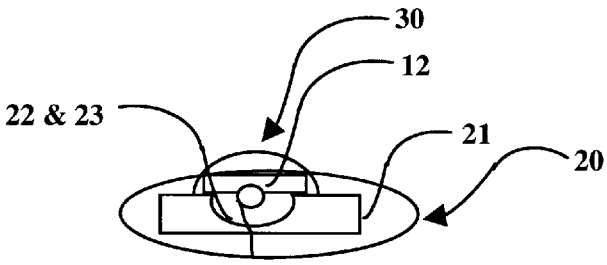
FIG. 3 is a side view of the preferred embodiment of the filament-mantle assembly 20.
Figure 4:
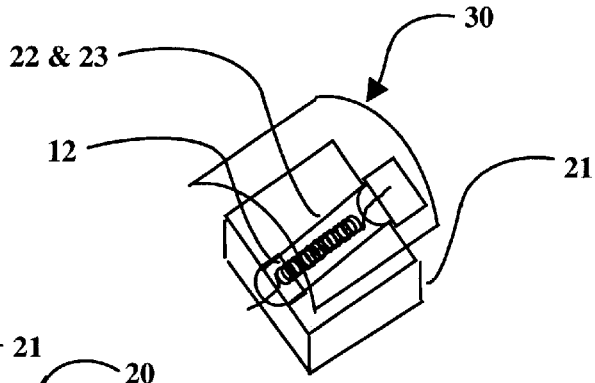
FIG. 4 is an isometric view of FIG. 3.

FIGS. 3 and 4 show a preferred embodiment with the addition of a cavity, item 23. FIG. 3 shows a end view, and FIG. 4 shows an isometric. The mantle, item 22 is placed inside item 23. The cavity, item 23 is formed in the low thermal capacity insulating material, item 21. The shape of item 23 is selected to be equidistant from item 12. Item 12 is shown as a classical coiled incandescent filament. Item 30 assembly is shown as a conical cover over the item 20 assembly, forming a two dimensional energy collector between items 21 and 30. Not shown are the supportive structures or the mechanism to prevent excessive filament sag when heated.

Figure 5:
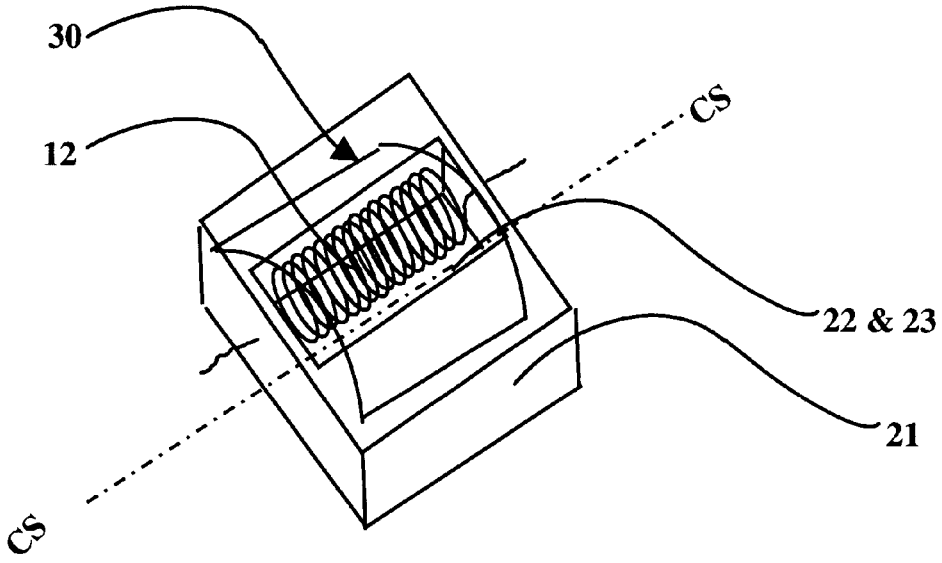
FIG. 5 is an alternate configuration of FIG. 3.
Figure 6:
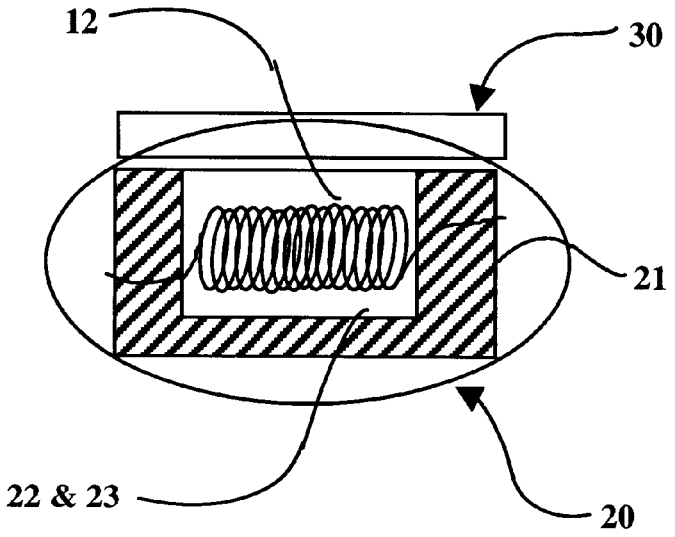
FIG. 6 is a cross sectional view from FIG. 3.

FIGS. 5 and 6 show an alternate configuration for the assemblies 20 and 30. FIG. 6 shows better detail for the alternate configuration of assembly 30. FIG. 6 shows a cutaway side view of the isometric shown in FIG. 5, marked by the line labeled CS in FIG. 5. A coiled incandescent filament, item 12, is placed in a cavity, item 23, formed in an insulator, item 21. The luminescent mantle, item 22 is coated on the interior cavity, item 23. Item 30 acts to trap the energy in the cavity, item 23, allowing only the desirable wavelengths to escape through item 30. Item 21 acts to trap the energy in item 23 that could escape through item 23. Supportive structure for the elements are not shown.

Figure 7:
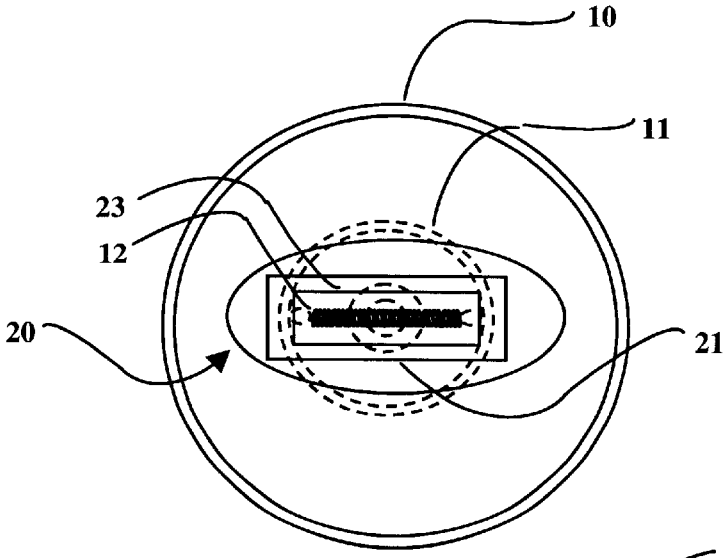
FIG. 7 is an top view of the integration of FIG. 5 assembly in a typical household light bulb.
Figure 8:
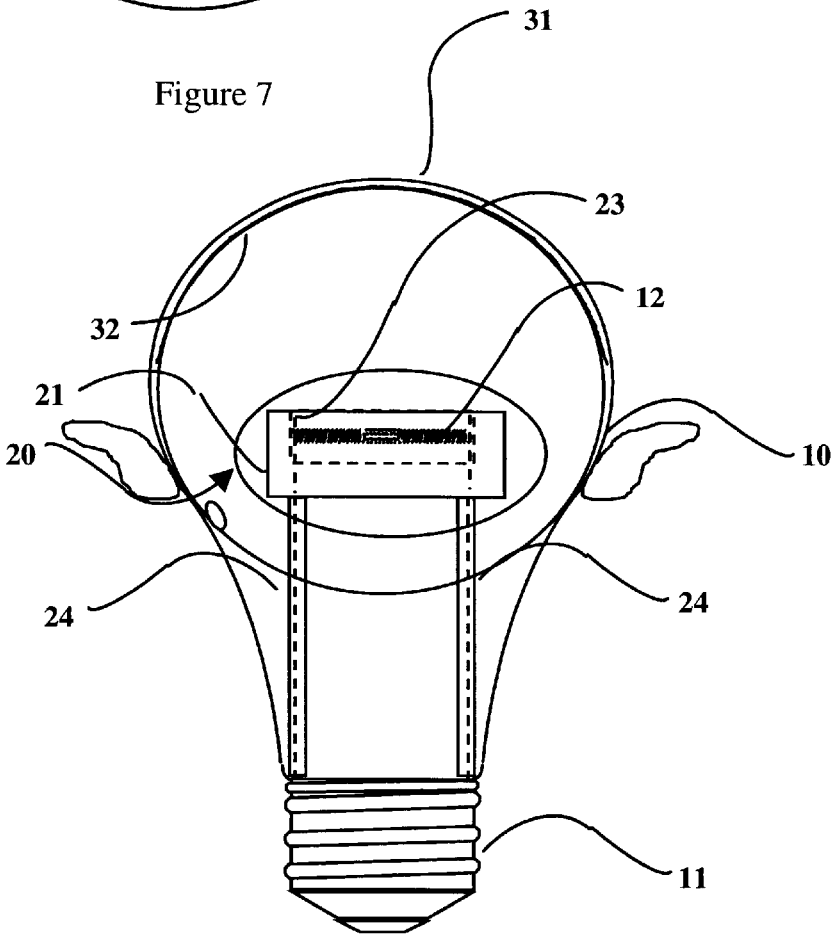
FIG. 8 is a side view of FIG. 7.

FIGS. 7 and 8 show the integration of part of the design shown in FIGS. 5 and 6 into a typical household lamp with a base, item 11. FIG. 7 is a top view, and FIG. 8 is a side view. In FIG. 8, a special structure to support the filter substrate, item 31, is not necessary needed because the lamp's outer envelope, item 10 is utilized. The existing shape of item 10 has sufficient shape accuracy to also act as the supporting member of item 31. The radiation emanating from item 20 assembly is directed to strike item 32 which is coated on the interior of item 10. The unwanted energy is reflected by item 32 back to the item 20 assembly. FIG. 7 shows the low thermal capacity insulator, item 21 with a cavity, item 23 and the incandescent filament, item 12 installed in the cavity, item 23. The assembly of items 12, 23 and 21 are defined as item 20. In FIG. 7, the lamp's base socket, item 11, is shown as the dotted circles. The outer lamp's envelope, item 10, is the common household "A" bulb shape.

Not shown in FIGS. 7 and 8 are the supporting elements for item 12 to prevent sag when energized. The support structure for item 20 is shown as item 24. The dashed line inside of item 24 represents the electrical lead-in wires connecting to the incandescent filament. The lamp's surface can also be frosted between items 31 and 32 to provide a more even light distribution.

Use of the outer envelope decreases the potential complexity by removing the requirement for an inner structure to support the discriminative filter. The capability to utilize existing bulb shapes is desirable because much of the lighting infrastructure requires certain bulb shapes. The decreased focusing accuracy requirements allow more degrees-of-freedom for substrate form design. The precise cylindrical, spherical and ellipsoidal shapes with the filament in the focal point are no longer the only practical designs. The form can now be non precisely ellipsoidal. The less stringent focusing requirements allows tolerance to thermal warping as compared to the prior art.

The mantle-insulator structure acts to both shade the lamp base and recycle the wasted energy into desirable light by luminescence. Additionally the insulator radiates the IR energy back to the incandescent filament, and blocks radiation in the undesirable directions. The efficacy is improved by trapping the wasted energy between the discriminative filter and the filament-insulator mantle structure.

Figure 9:
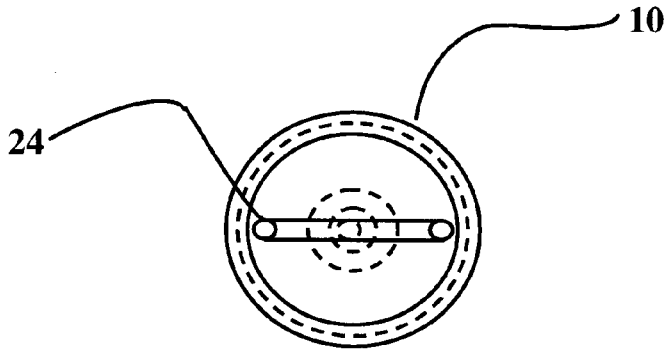
FIG. 9 is an top view of the integration of the filament support structure assembly in a typical tubular light bulb.
Figure 10:
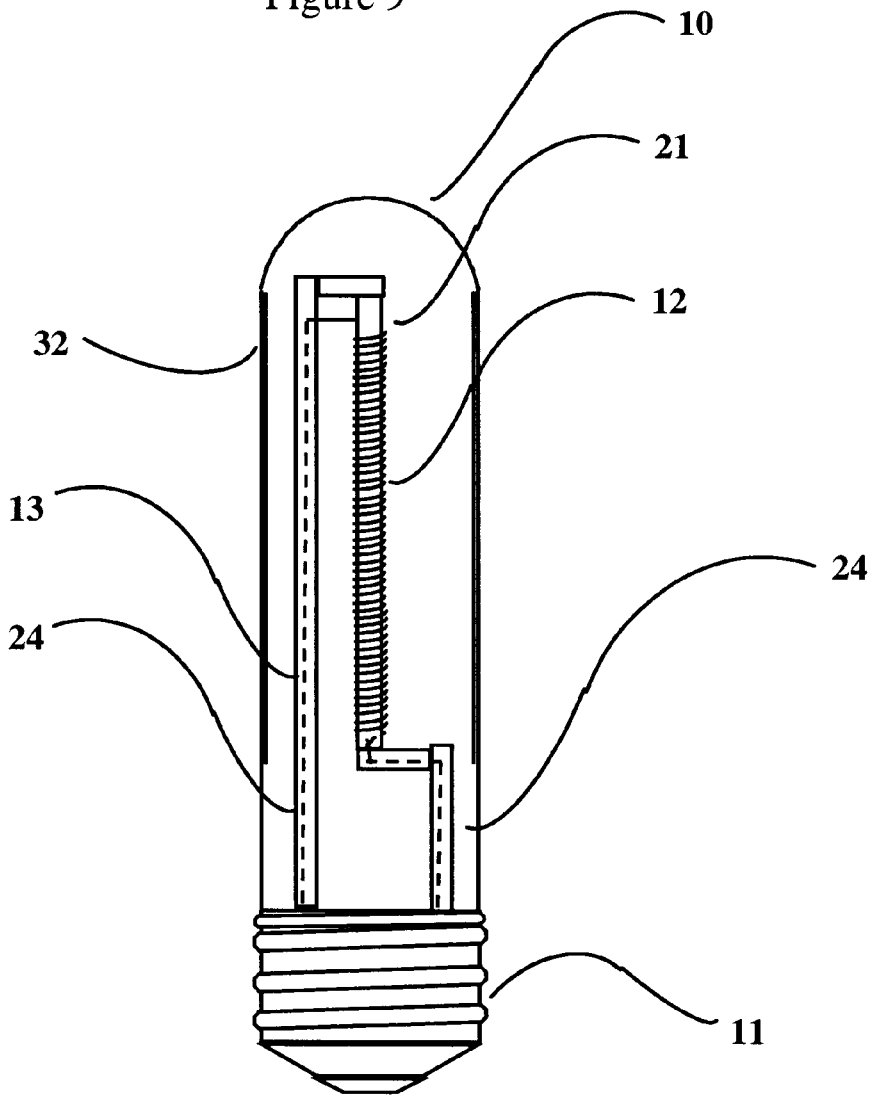
FIG. 10 is a side view of FIG. 9.

FIGS. 9 and 10 show incorporation of the objects of our invention into a tubular design configuration. FIG. 9 is a top view and FIG. 10 is a side view of the tubular example. The low thermal capacity insulator item 21, is shown with the incandescent filament, item 12 loosely wrapped in a coiled fashion around it. The candoluminescent material is coated on the surface of item 21, but not shown. The supporting structure, item 24, maintains the filament near the center of the lamp's outer envelope, item 10. The discriminative filter, item 32, is shown mounted on the interior sides of item 10. The filament's electrical lead-in wires, item 13, are shown as the dashed lines inside the supporting structure, item 24. The configuration is shown with the standard lamp mounting base, item 11. Item 21 can alternately be constructed of a candoluminescent rod similar to the construction described in U.S. Pat. No. 4,016,446 by Cadoff; Laurence H. titled "Refractory-Oxide-Based Incandescible Radiators and Method of Making." The element described can be utilized without the carbon doping to provide item 21 in our design.

Tubular lamps as shown in FIGS. 9 and 10 benefit from use of a low thermal capacity incandescent filament structural support. The low thermal capacity support acts to maintain the filament at the center of the tube, and maintain the filament at the natural focal point. Mounting the discriminative filter on the inner wall of the tubular envelope provides a safer temperature environment because incandescent filament warping disallows local hot spots caused by the filament moving toward the inner envelope. Coating the support structure with candoluminescent materials act to further transform the heat energy to desirable wavelengths.

Figure 12:
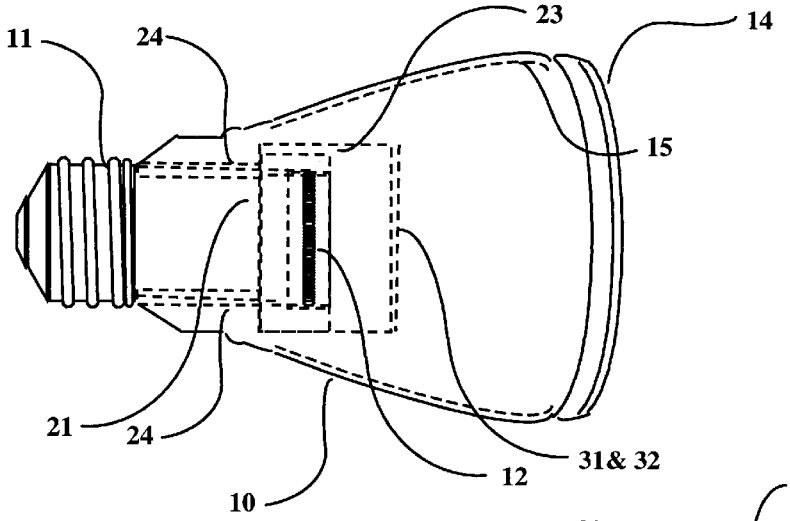
FIG. 12 shows a typical lamp with a directed beam output using a lens.
Figure 11:
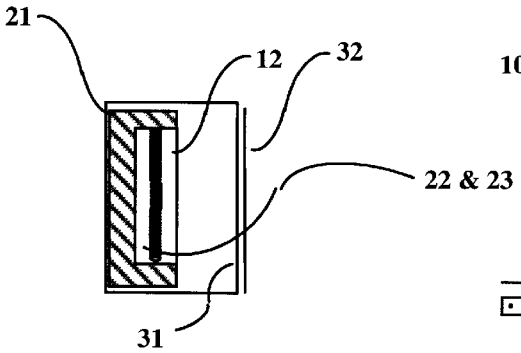
FIG. 11 shows a cross section of the interior assembly used in FIG. 12 & 13 embodiments.
Figure 13:
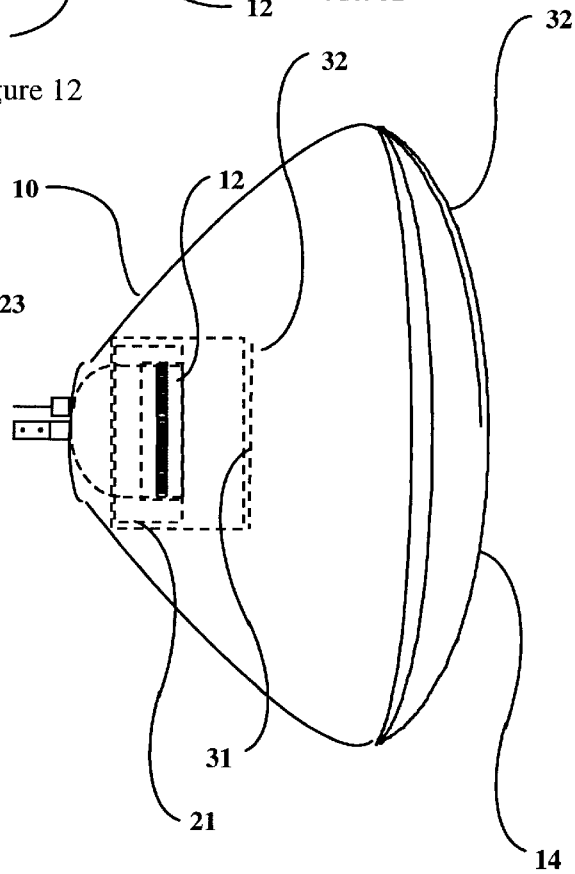
FIG. 13 is a preferred embodiment for a typical automobile headlight design.

FIG. 11 shows a cross section of the interior assembly used in FIGS. 12 and 13's embodiments. The FIG. 11's cross sectional view is similar to the cross sectional view shown in FIG. 5 except for the additional details of the item 31 and 32. FIG. 11 shows a cross section of the low thermal capacity insulator, item 21, sectioned to show the internal cavity, item 23, that is lined with the candoluminescent mantle material, item 22. The incandescent filament, item 12, is installed inside item 23. The lamp's internal structure includes a substrate, item 31, which acts to support the IR discriminative filter, item 32, coated on the face of the substrate, item 31. Wasted IR energy is reflected by item 32 on the inner structure back to the mantle-filament.

FIG. 12 shows a typical lamp with a directed beam output which typically uses a lens, item 14, and reflector coated interior on item 10 shown as a dashed line next to item 10 inner surface. The mirrored coating on item 10 is not required in our design to shape the beam, therefore the coating is represented by the dashed line. The lamp's inner assembly represented by FIG. 11 shapes the beam without the requirement for the mirrored coating of item 10. The reflector lamp is shown with the standard base socket, item 11. An interior support structure, item 24 supports the interior insulator, item 21. A cavity, item 23 is formed in item 21 which houses item 12. The output radiation beam pattern generated by both items 12 and the mantle, which is inside the cavity and not labeled in FIG. 12, are shaped by the cavity, item 23. Refer to FIG. 11 for mantle location. A reflector coating, item 15, is installed on the interior of item 10 as is typically required in the prior art. However, in this design, the mirror coating, item 15, is unnecessary, and can be deleted from the design. A substrate, item 31, supports a discriminative filter item 32. The discriminative filter, item 32, is a wavelength discriminative filter used to improve efficacy. Item 32 can also be placed on item 14.

FIG. 13 is a preferred embodiment for a typical automobile headlight design. The assembly shown in FIG. 11 is installed into the headlight outer envelope, item 10. The low thermal capacity substrate, item 21 is shown adhered to the interior of the lamp envelope, item 10. Item 32 is shown installed in two places. The location of item 32 installed on item 31 is a wavelength discrimination filter designed to improve the efficacy. The item 32 shown covering part of item 14 is a polarization discriminative filter, a special case of item 32. The linear polarized mirror provides selective attenuation of the automobile high beam, as described in our U.S. patent application Ser. No. 08764705. Note that the polarization filter only extends over the high beam radiation output area. Note that the beam shape emitted by item 12 is shaped by the cavity in item 21. The reflected energy from item 32 installed on item 31 reflects the rejected wavelengths for recycling. Item 32 installed on item 14 reflects the non-polarized components that can escape through the lower part of item 14 which constitutes the low beam, or return to the filament-mantle for energy recycling. Not shown is the mirrored plating on the interior of item 10.

Figure 14:
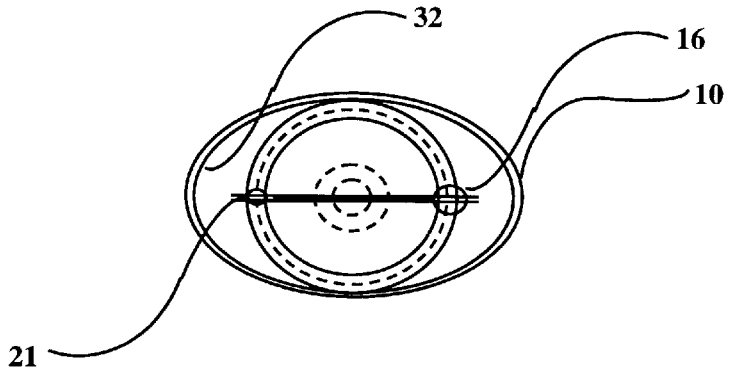
FIG. 14 is a top view the preferred embodiment for a typical sodium street lamp.
Figure 15:
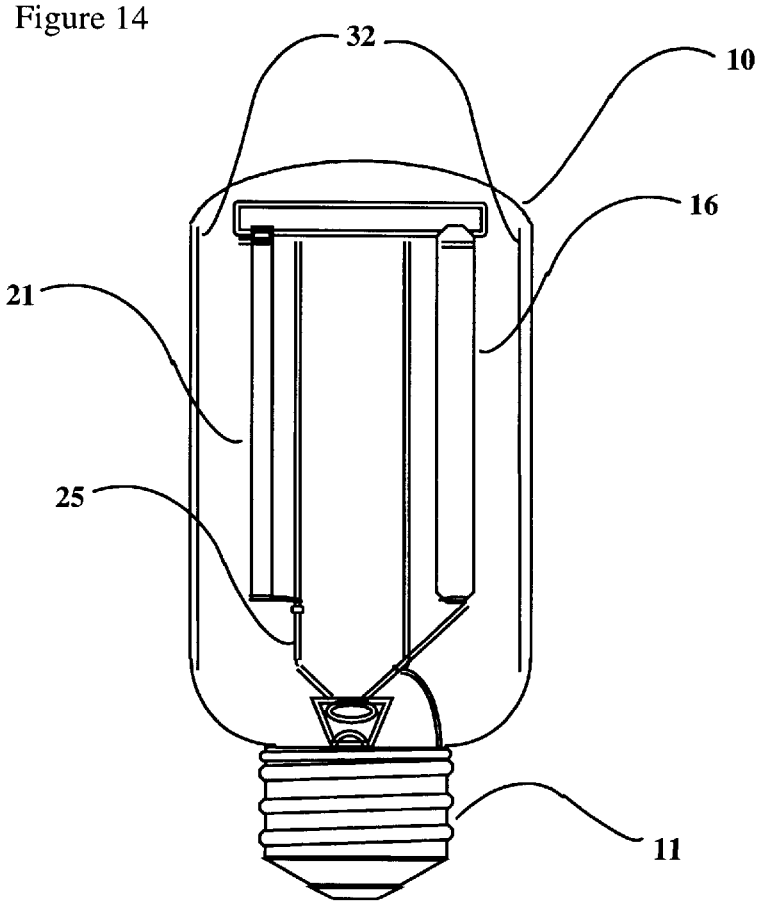
FIG. 15 shows a cross section of the interior assembly of the sodium street lamp.

FIGS. 14 and 15 show a High Energy Discharge Lamp used in conjunction with a candoluminescent mantle. The outer lamp envelope is ellipsoidal, with the arc tube located at one foci and the mantle located at the second foci. The reflective discriminative filter which includes a linear polarizing filter is placed on the lamp's outer envelop so that the discriminative filter is shaped elliptically. FIG. 14 is a top view and FIG. 15 is a side view. The inner arc tube containing the high pressure sodium is shown as item 16 at one foci of the elliptical shaped lamp. The outer lamp envelope, item 10 is of ellipsoidal shape, as specifically seen in the top view of FIG. 14. At the other foci of the ellipse, is placed items 21 as shown. A linear polarized filter, item 32 is wrapped on the inner section of item 10. The structure to support items 16 and 21 is shown as item 25, which also carries current to the top end of item 16. The lamp is shown with the standard screw type base, item 11. This design supports the application of linear polarized street lamps.

B. DETAILED DESCRIPTION OF INVENTION

There are several main objects to the present invention which improves the efficacy and the chromatic quality of the conventional incandescent lamp designs. These objects are use of a (1) low thermal capacity, high efficiency insulator, (2) use of candoluminescent materials as a secondary emission source, and (3) use of a mirrored polarized filter. These objects are integrated to provide (4) an efficacy improved manufacturable lamp design that requires less stringent accurate reflector shapes as compared to the prior art's requirements. These main objects are discussed below.

1. CANDOLUMINESCENT MANTLE, ITEM 22

The mantle is composed of candoluminescent material that will emit desirable wavelengths when heated and act to provide a secondary light source in addition to the incandescent filament. The mantle provides a larger target than the small incandescent filament, allowing less optical precision alignment for the reflecting filters which focus the unwanted energy back for energy recycling. The entire mantle need not be thermally heated to luminescence, therefore, for example, if the reflecting IR or mirrored polarizing sheet is shaped in a cylindrical shape with the mantle at approximately the focus, the reflecting sheet will focus the unwanted energy in a line on the mantle.

The mantle material is a selection of candoluminescent materials such as thorium oxide or alkali and rare earth metals, such as zirconium, potassium, yttrium, erbium and cerium similar to the gas lantern mantle composition. Selection and proportional composition of these materials determines desired luminescence and chromaticity as well as color rendering quality. A preferred embodiment of the present invention contains these earth metals in a typical percentage or proportion as described in U.S. Pat. No. 4,532,073 by Cornu; Aime, et. al. titled "Candoluminescent Material and its Preparation". However, the concentrations are tailored to the desired lamp application and desired output chromaticity.

2. LOW THERMAL CAPACITY INSULATOR, ITEM 23

The insulator is a special ceramic fiber product ideal for high temperature insulation with low thermal capacity. These products are fibrous refractory products based primarily on refractory ceramic fibers. There are two basic fiber types which are amorphous and polycrystalline. Ceramic fibers are low alkali alumina-silicate compositions which contain other oxides such as zirconia or chromia to improve service temperatures and other physical properties. These products exhibit very low thermal conductivity and low heat storage. The space shuttle tiles are an example of an existing application. There are a variety of choices available on the market. ZIRCAR provides a zirconia board rated to 2200° C. High temperature products include TiC rated at 3067° C.; however, TiC is highly thermally conductive. The preferred embodiment insulator as shown in FIGS. 1–8, and FIGS. 12–13 are made of yttria stabilized zirconia bulk fibers or alumina-silica which withstand high operating temperatures and both are commercially available [e.g. ZIRCAR Products, Inc., Florida, N.Y.].

The insulator provides several functions in our design:

(a) Structurally supports the mantle and or incandescent filament.

(b) Act as a thermal protector to shade the lamp base from the incandescent generated energy.

(c) Form a partial energy trap to minimize thermal conduction and radiant energy in a selected solid angle.

(d) Act in conjunction with the mantle to form a directed shaped beam without the requirement for reflecting mirrored envelope.

The specially selected insulators have a very low thermal capacity. Typically, 90% of these materials are void. The low thermal capacity insulators thus act to support the mantle without thermally draining the mantle's thermal energy via insulator thermal conduction.

Special high temperature low thermal capacity insulators can also act as a filament supports which will maintain the filament at a particular location such as the center of a tubular lamp design. Maintaining a filament at the center of a tubular lamp is necessary when using a discriminative filter to reflect the unwanted radiation back to the filament for energy recycling. See FIG. 10. A TiC insulator can survive the temperature environment.

3. MIRRORED POLARIZING FILTER, ITEM 32

The energy losses from the non-polarized components of the emitted light can be reduced by providing a mirror polarizing reflective filter that transmits the desirable linear polarized light and reflects the unwanted incorrectly polarized radiation back for recycling. If an IR filter is used in conjunction with the mirrored polarizing sheet, the unwanted IR radiation is also reflected for recycling. Recycling is accomplished by focusing the unwanted energy back to the generating incandescent filament or a secondary mantle regenerating source.

Low temperature linear polarized reflective mirror filters are commercially available. For example, samples of the mirrored polarizing sheets are available from Edmund Scientific therein referenced to as "mirrored polarizing sheet" available on glass as well as plastic. FIG. 13 shows a liner polarized headlight design that linearly polarizes the high beam for selective attenuation. The FIG. 13 example reflects the unpolarized light that can be re-absorbed by the filament-mantle, or re-emitted as part of the low beam radiation.

4. INTEGRATION ADVANTAGES AND MANTLE FABRICATION

Integration of the insulator-mantle designs provides a larger target for the discriminative filter's reflected energy. Thus the use of IR filters is more practical because the reflected energy is more easily directed toward the larger item 20 rather than the smaller item 12. The shaped form of item 30 is not driven to precise optical forms with precision relative placement of the incandescent filament with respect to the discriminative filter focus. The relaxed precision allows adaptation of the IR reflector design to existing lamp shapes by using the existing outer envelopes, item 10, to support the discriminative filter, item 32. Item 32 is not required to provide focused reflected energy. The energy need only be incident on the larger mantle filament structure in sufficient concentration to cause luminescence.

The mantle candoluminescent properties are applied to the fibers of the ceramic insulator, or formed as a fibrous body similar to the existing gas lantern mantle, and applied to the insulator. The preferred embodiment of item 22 mantle material is initially a selective alkali and rare earth metals, such as zirconium, potassium, yttrium, erbium and cerium combined with possible organic fiber similar to the gas lantern mantles. Preparation is accomplished by impregnating a mixture of combustible textile fibers with a solution of zirconium and calcium salts, optionally containing aluminum, iron, manganese, praseodymium and/or cerium salts and then spreading the mixture onto the insulator to form the mantle. The assembly 20 structure is subjecting to a combustion process in order to eliminate the textile and transform the salts into oxides. The resulting surface is a micro thin stringy capacity of mantle material, and a coating of mantle material on the underlying micro stringy thermal insulator. The assembly 20 heat-treating outgases any undesirable impurities prior to installation into the lamp.

C. THEORY OF OPERATION

Our patent has several main objects which can be utilized separately to improve efficacy; however, when integrated, additional advantages are available. The objects are:

(1) Use of Candoluminescent Materials to:

(a) act as secondary desirable light generator, using the wasted energy generated by the incandescent filament, to generate light via luminescence;

(b) act as a larger target to receive and recycle the discriminative filter reflected energy for light regeneration, thus providing for a relaxed form for the reflective filter substrate;

(c) act as a source of additional wavelengths to augment the black body color spectrum from the incandescent filament.

(2) Provide a Low Thermal Mass Insulator Structure That:

(a) structurally supports the mantle and or incandescent filament;

(b) acts as a thermal protector to shade the lamp base from the incandescent generated energy;

(c) forms a partial energy trap to minimize thermal conduction and radiant energy in a selected solid angle;

(d) acts in conjunction with the mantle to form a directed beam without the requirement for reflecting mirrored envelope.

(3) Provide a Mirrored Linear Polarized Filter That:

(a) transmits desirable polarized light and (b) reflects unwanted polarization components back for energy recycling.

Luminescence is a phenomenon wherein certain compounds emit particular wavelengths when excited by some stimuli. The stimuli can be electrical, chemical or thermal. The first application of thermal luminescence was use of CaO for artificial light generation. The CaO when held in a candle flame exhibited brighter visible light output then the candle flame. The thermal luminescence phenomenon is utilized in today's gas lanterns. These thermally stimulated luminescent materials exhibit the luminescence phenomenon at temperatures lower than required to output the same wavelengths using black body radiation. Thus the tungsten filament, which is a black body radiation light source, is required to be at a temperature of approximately 2550° C., while luminescence, depending on the compound, can emit visible radiation at much lower temperatures. If the luminescent materials are heated too high, thermal quenching occurs . At the higher temperatures the materials output radiation in the IR bands rather than in the luminescent bands.

This combined co-generation of visible light, from both the incandescence of the filament and the luminescence of the mantle, affords efficacy improvements over the prior art. The lamp's spectrum output is a combination of the black body filament output spectrum and the luminescence spectrum from the mantle materials. The combined light output has more design degrees of freedom to select desired chromaticity and color rendering index (CRI) ranges by changing the mantle material composition. The incandescent filament is rich in the reds, while the luminescent material can be rich in reds or blues, allowing for desired color rendition.

The structure of a mantle offers a larger area to focus wasted energy which allows the focusing substrate to be of relaxed form. Thus the advantages of placement allow a more practical design.

The low thermal capacity insulators are typically stringy ceramic materials that are 90% void. The thermal conduction properties and thermal capacity are quite low. A sample of insulator used in space shuttle tiles can be handled with the unprotected hand even when heated red hot.

The low thermal capacity insulator, item 21, can further act to restrict undesirable heating by virtue of its inherent low thermal conductivity and low thermal capacity properties. The insulator, item 21 can act to reflect and concentrate the IR energy back to the tungsten filament if the insulator conforms to a concentrating shape that directs the energy toward the incandescent filament suspended at the cavity's natural focal point.

Wavelength discriminating reflective coatings are used to reflect the undesired light back to the filament-mantle structure for energy recycling, while allowing the desirable light to radiate from the lamp. The low thermal capacity insulator-mantle-filament assembly, item 20, provides a larger target than just the incandescent filament, item 12, allowing less precision for the substrate, item 31, supporting the discriminative reflecting filter, item 32. As a result many existing lamp's outer envelope shapes, item 10, have adequate optical precision to be utilized as a substrate, item 31, to reflect the wasted energy back for recycling. An example is shown in FIG. 8 using a PAR lamp body.

The wavelength discriminating reflective coating, 32, on the bulb's, 10, inner envelope can also include a special case of item 32 which is linearly polarization discrimination. For example if the linear polarized coating, 32, is applied to the inside of the exterior envelope as shown in FIG. 13, the design provides a new product which is a linearly polarized automobile headlight. The linearly polarized light output has enormous safety applications, as described in our Patent application, Ser. No. 08764705. The linear polarization angle is set at approximately 45° from normal in our example.

The embodiments of this invention can also be applied to a High Intensity Discharge lamp as shown in FIGS. 14 and 15. In this case, the wasted radiation generated by the arc tube discharge is reflected by a discriminative filter and focused onto item 21 to regenerate the recycled energy into desirable radiation. The ellipse has two focal points. Energy generated at one foci and reflected from the ellipse's inner surface is focused at the second foci. The sodium discharge is placed at one foci, the wasted reflected radiant energy is focused to the other foci, where item 21 is placed. Wasted energy from item 16 is reflected by item 32 to item 21, causing a cogenerating candoluminescent light generation. This design utilizes the ellipse's optical property of concentrating energy generated at one foci to the other foci. Laser flash lamp designs utilize this phenomenon. The linear polarization angle is set at approximately 45° from normal in this design example which conforms to the headlight design.

D. Conclusions, Ramifications and Scope of Invention

1. Conclusions objects of this invention are new techniques to improve efficacy for incandescent lights. Integration of these new techniques with existing prior art designs, provides more practical designs allowing fuller utilization of the prior art. These techniques include the following factors:

(1) Use of Candoluminescent Mantle Materials to:

(a) act as secondary desirable light co-generator, using the wasted energy generated by the incandescent filament, to generate light via luminescence;

(b) act as a larger target to receive and recycle the discriminative filter reflected energy for light regeneration, thus providing for a relaxed discriminative filter shape, not requiring precision focusing;

(c) act as a source of additional wavelengths to augment the color spectrum of the black-body incandescent filament.

(2) Use of a Low thermal Capacity Insulator Structure That:

(a) structurally supports the mantle and or incandescent filament;

(b) acts as a thermal protector to shade the lamp base from the incandescent generated energy;

(c) forms a partial energy trap to minimize thermal conduction and radiant energy in a selected solid angle;

(d) acts in conjunction with the mantle to form a directed shaped beam without the requirement for reflecting mirrored envelope.

(3) Provide for a Mirrored Linear Polarized Filter That
  (a) transmits desirable polarized light, and
  (b) reflects unwanted polarization components back for energy recycling.
(4) Integrating these Elements in a Cooperative Manner to:
  (a) promote efficacy of desirable light wavelengths and simultaneously
  (b) enhance the color rendering by selection of desirable wavelength luminescent materials.

These factors are the main sources to achieve the high efficacy of co-generating incandescent and candoluminescent light.

2. Ramifications

FIGS. 1 through 6 show the elements of the design. The elements can be applied singularly or in various combinations. Various shapes and configurations of each element are possible and are described below:

Mantle composition selection, item 22, is a function of: (a) desired chromaticity design, (b) temperature that the material fluoresces, and (c) physical properties that include volatility, strength, and physical form. The mantle can be applied to any part of the insulator(s) surface. The preferred embodiment of item 22 mantle material is a mixture of selective alkali and rare earth metals, such as zirconium, potassium, yttrium, erbium and cerium combined with possible organic fiber similar to the gas lantern mantles. An alternate material is the typical gas lantern mantle of thorium oxide, which is weakly radioactive. Other compounds offer luminescence at different luminescent wavelengths. The mix provided herein is an example. Actual selection is a function of mantle temperature versus luminescent temperature, and desired luminescent wavelengths. The mantle can also be placed in locations removed from the incandescent filament, to be heated to luminescence by reflected energy.

Mantle locations can be in near proximity to the incandescent filament, or placed at some other convenient location to receive the reflected or refracted energy for recycling.

The mantle can also be heated partially or to luminescence via a electrical current.

The shape of the insulator, item 21, can be a small block to a fill extending to the lamp's socket(s). The insulator shape next to the filament can vary from curved concave, convex or multifaceted sections both in a concave or convex form or faceted flat sections. The insulator may exhibit a rough textured surface design to increase the surface area for mantle application. A concave design has the advantage of concentrating IR energy back to the incandescent filament, but the disadvantage of also directing the desirable luminescent generated light back to the filament. A convex shaped insulator has the advantage of radiating the emitted luminescent generated light into a greater solid angle than in the concave shape, but has the disadvantage of not concentrating recycled energy back to the filament. Several insulators provide a possible configuration where the energy concentrator is near the filament, and other insulators with their mantle are placed elsewhere.

Volume may be removed from the insulator with a hole pattern to augment the microscopic voids and further decrease the thermal capacity.

The insulator material can be selected from a family of ceramic fiber compounds that exhibit low thermal capacity and sufficient temperature survivability. Material utilized for space shuttle tile is an aluminum silicate which survives at temperatures to 1704° C. These insulators are available examples, but the design is not restricted to the examples. The insulator may be formed of specific candoluminescent materials, providing for a design wherein the insulator and mantle are the same object. The low thermal capacity insulators are a family of fibrous structures whose volumes have been typically achieved as 90% void or less. An insulator composed of rare earth metals or alkali oxides can be formed by mixing the soluble materials with a combustible organic fiber, and heating to burn the organic fibers, similar to gas mantle production.

The insulator may also be formed of a sandwich type construction of composite materials. Areas near the filament may be very high temperature materials or preferably candoluminescent fibrous materials, while the other parts of the insulator may be very low thermal capacity, very low thermally conductive materials. Ceramic fiber products are used because of their low thermal conductivity and low heat storage as compared to available insulating materials. However, other non-ceramic materials such as asbestos can be substituted.

The filter substrate assembly, item 20, comprised of the discriminative filter and the substrate can be of multiple forms which include an inner bulb substrate structure, or the outer bulb envelop, item 10. The reflective filter can be applied to inner or outer surfaces of both the inner and outer structure. The shape of the substrate, item 31, need direct energy back to item 32 and or item 12. Item 31's acceptable geometry is a function of item 31 and 32 size. Item 31's preferred embodiment shows a curved shape over the cavity which can vary from highly elliptical to flat without the requirement to maintain the incandescent filament at the focus. A high percentage of the focused energy need only be directed into the mantle, item 32. The entire mantle need not be heated.

FIG. 10 shows a prior art tubular design which can be used as a inner bulb configuration, or as applied to the household halogen lamp with mounting base on each end. The advantage by our design is to maintain the incandescent filament at the center of the tubular structure as well as benefits from a mantle similarly situated. The tubular design applies to many mounting base configurations, and is not restricted to the base as shown in FIG. 10. Using a tubular inner substrate with the above placement allows freedom of shape for the outer lamp envelop.

The filament, item 12, can be any conventional or improved incandescent filament made of tungsten, other metals, or candoluminescent materials. The incandescent filament may include a core of high temperature insulator materials, and combine the properties of the insulator and the mantle, providing light via luminescence rather than black-body radiation. The construction may be of a single unit or disconnected units as shown in the design examples provided herein. A possible configuration is using a combination mantle-filament where the mantle-filament is placed on the surface of the low thermal capacity insulator in the same fashion as the mantle. The mantle-filament in this configuration is heated by the electrical current through the mantle-filament and the discriminative filter reflected energy. The low thermal capacity insulator can be used to bound the thermal energy to the desired light emission directions. The electrical heating can be accomplished via a metal wire mesh that is at or near the surface, or doping the luminescent material with a conductive material.

FIG. 10 shows the a tubular design with a incandescent filament coiled around a mantle-insulator configuration. This configuration can take many forms which includes a insulator without the candoluminescent material, a sheath of semi-conducting material over the surface of the insulator that acts as a filament. The preferred embodiment shows a cylindrical form; however, shape is not a critical part of the design.

The objects of this invention can be applied singularly or in various combinations. For example, placement of item 21 below a conventional lamp without the use of a mantle, beneficially acts to reflect energy back to the filament as well as shade the lamp's base.

FIG. 15 shows a High Energy Discharge Lamp used in conjunction with a candoluminescent mantle. The outer lamp envelope is ellipsoidal, with the arc tube located at one foci and the mantle located at the second foci. The ellipsoidal shape may also be applied to a inner structure, allowing the outer structure to be of arbitrary shape.

The reflective discriminative filter may provide discriminative wavelength reflection and/or linear polarization discrimination.

The FIG. 15 High Energy Discharge lamp can be of any arc tube design that supports desirable radiation generation, such as mercury.

The FIG. 15 form of the reflective filter can also be of lens design to focus the reflected energy back to the candoluminescent structure. Typical designs are required to minimize heating of the arc tube.

The FIG. 15 item 21 can also be partially heated by use of an electric current. The mantle heating may be by both arc tube wasted radiation and a current through the mantle.

The scope of this invention is not limited to the design examples provided herein. The benefits of our invention are applicable in a very diverse set of situations where incandescent or High Intensity Discharge artificial light sources efficacy can be improved using one or multiple of the techniques described herein. Various combinations of luminescent materials with different concentrations and different selections of low thermal capacity insulating materials does not constitute a new design.

The scope of this invention should be determined by the appended claims and their legal equivalents, rather than by the examples given.

What is claimed is:

1. A color rendering general service incandescent lamp comprising:

(a) at least one base;

(b) transparent inner and outer envelopes attached to said base;

(c) a radiation discriminative reflective film for reflecting radiation for recycling energy;

(d) a lamp filament electrically connected to the base through leads;

(e) a lightweight insulative low thermal mass fibrous ceramic material spatially formed and positioned to shade the lamp base from the radiation emitted form the filament and to shade the radiation reflected from the radiation discriminative reflective film, the fibrous ceramic material being treated with a candoluminescent material to form a mantle for emitting radiation when thermally excited by the filament or when the radiation is reflected from the radiation discriminative reflective film, Wherein a wavelength and polarization discriminative reflective film is provided on one of the inner and outer envelopes for directing the reflected radiation toward the filament.

2. A color rendering general service lamp as claimed in claim 1, wherein the shape of the inner or outer envelope is flat or singularly flat or of doubly curved form.

* * * * *